US005152316A

United States Patent [19]

Dörr

[11] Patent Number: 5,152,316

[45] Date of Patent: Oct. 6, 1992

[54] SERVO DRIVE FOR SAFETY AND REGULATING VALVES

[75] Inventor: Hermann Dörr, Herzogenaurach, Fed. Rep. of Germany

[73] Assignee: Siemens Aktiengesellschaft, Munich, Fed. Rep. of Germany

[21] Appl. No.: 757,045

[22] Filed: Sep. 9, 1991

Related U.S. Application Data

[63] Continuation of PCT/DE90/00160, Mar. 6, 1990.

[30] Foreign Application Priority Data

Mar. 7, 1989 [DE] Fed. Rep. of Germany ..... 3907289

[51] Int. Cl.[5] ..... F16K 31/04; F16K 31/50

[52] U.S. Cl. ..... 137/487.5; 251/129.11; 251/249.5

[58] Field of Search ..... 137/487.5; 251/129.11, 251/249.5

[56] References Cited

FOREIGN PATENT DOCUMENTS 2416653 10/1975 Fed. Rep. of Germany .

*Primary Examiner*—Gerald A. Michalsky

*Attorney, Agent, or Firm*—Herbert L. Lerner; Laurence A. Greenberg

[57] ABSTRACT

Safety and regulating valves of safety stations meter energy flows in the form of gases, steam or water, in particular in thermal or industrial power plants. In a servo drive for the valves, a drive force for a safety movement of a restrictor body is derived from a working-medium pressure difference acting on the restrictor body. To this end, the spindle drive of the safety valve is constructed in such a way as to be non-self-locking. A rapid-travel mechanism is used instead of a rapid-travel motor. The rapid-travel mechanism is coupled through a non-self-locking gear unit to a planetary gear stage of the servo drive and has a shaft being normally securely braked by a releasable brake device. When the response pressure occurs, the brake device releases the rapid-travel mechanism to perform the safety movement of the restrictor body into its required position by means of the inherent medium. In a positive direction of action, the required position is the open position of the restrictor body, and in a negative direction of action the required position is the closed position.

17 Claims, 4 Drawing Sheets

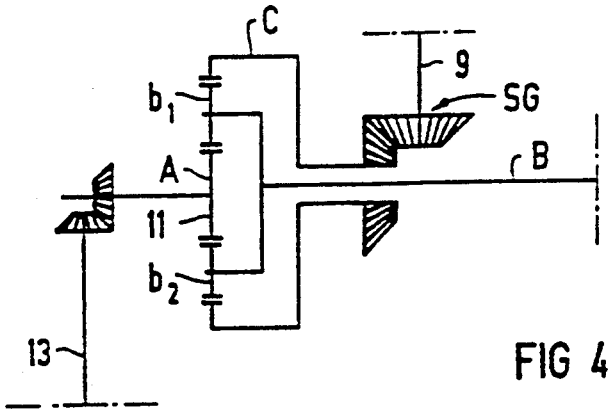
FIG 4
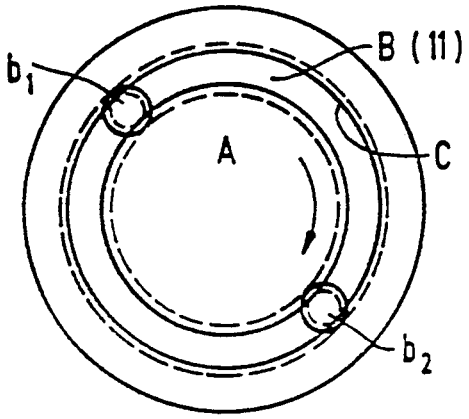
FIG 5
| | Regulating Operation | Opening command $P > P_{GR}$ |
|---|---|---|
| A | Driven | Fixed or moving |
| B | Taken along with A | Taken along with C |
| C | Securely braked | Brake lifted |
| Remarks | C is a fixed roller track for b1, b2 | A is a roller track for b1, b2 |
FIG 6

SERVO DRIVE FOR SAFETY AND REGULATING VALVES

CROSS-REFERENCE TO RELATED APPLICATION

This application is a Continuation of International Application Ser. No. PCT/DE90/00160, filed Mar. 6, 1990.

The invention relates to a servo drive for safety and regulating valves of safety stations for metering energy flows in the form of gases, steam or water, in particular in thermal or industrial power plants, each safety valve having at least one restrictor body being adjustable relative to a valve seat and opening or closing a restrictor cross-section through which a working medium flows, when a response pressure reaches or exceeds a permissible pressure on an inflow or outflow side of the safety valve, the servo drive including a spindle drive for the restrictor body, and a planetary gear stage coupled to the spindle drive for the superimposable introduction of a first drive torque from a regulating drive having a regulating motor and of a second drive torque through a rapid-travel mechanism to rapidly open or close the valve when the response pressure is reached or exceeded.

In process and power-plant engineering, energy flows of many different types have to be reduced or metered. This is done mainly through appropriate reducing valves in combination with various servo drives. At the same time, all pipeline systems and vessels or components must be protected against excessive pressures. Such tasks are mostly undertaken by safety valves of the most varied types of construction.

If the pipeline and vessel systems located upstream of the safety valves in the direction of flow are to be protected from excess pressure in such a case, the safety valves are referred to as safety valves having a positive direction of action. Such safety valves must open reliably at excess pressure. If the systems located downstream of the safety valves in the direction of flow have to be protected from excess pressure, the safety valves are referred to as safety valves having a negative direction of action. Such safety valves must close reliably.

Safety stations or associated safety valves and servo drives are meant to undertake both tasks, namely defined reduction or metering of energy flows and protection of the plant system from excess pressures. If the safety stations concern steam valves in which the steam is also simultaneously cooled by a supply of cooling water, the safety stations are referred to as steam-converting safety stations.

Starting from a servo drive of the type defined initially above, which is essentially disclosed, for example, by the Siemens advertising publication "Hochdruck- und Niederdruck-Umleitstationen für Kraftwerke mit fossiler Feuerung" (High-pressure and low-pressure diverting stations for power plants fired by fossil fuels), Order No. A 19 100-E 621-A7-VI, it is an object of the invention to provide a servo drive for safety and regulating valves, which overcomes the hereinafore-mentioned disadvantages of the heretofore-known and devices of this general type and to do so in such a way that in principle a safety station having a positive or negative direction of action can be realized. In particular, the safety of so-called bypass stations is to be increased, the regulating times are to be reduced, the connected power of the servo drives is to be reduced and finally favorable pricing is also to be achieved without loss of functionability.

With the foregoing and other objects in view there is provided, in accordance with the invention, in a safety station having a safety and regulating valve for metering energy flows in the form of gases, steam or water, in particular in thermal or industrial power plants, the valve having an inflow side, an outflow side, a valve seat, and at least one restrictor body defining a restrictor cross-section through which a working medium flows, the at least one restrictor body being adjustable relative to the valve seat for opening or closing the restrictor cross-section when a response pressure reaches or exceeds a permissible pressure on one of the inflow and outflow sides, a servo drive for the valve, comprising a non-self-locking spindle drive for the restrictor body, a regulating drive having a regulating motor, a rapid-travel mechanism, a planetary gear stage coupled to the spindle drive for superimposing an introduction of a first drive torque from the regulating drive and a second drive torque through the rapid-travel mechanism for rapidly opening or closing the valve when the response pressure is at least reached, means for deriving a drive force for a safety movement of the restrictor body from a working-medium pressure difference acting on the restrictor body, a non-self-locking gear unit coupling the rapid-travel mechanism to the planetary gear stage, the non-self-locking gear unit having at least one shaft, a releasable brake device normally securely braking the at least one shaft, and the brake device releasing the rapid-travel mechanism for performing the safety movement of the restrictor body into a required position with the inherent medium, when the response pressure occurs.

In accordance with another feature of the invention, the spindle drive for the restrictor body has a valve spindle, a spindle nut rotatably mounted on the valve spindle, a spindle-nut housing rotatably mounting but axially fixing the spindle nut, and an output-shaft journal on the spindle-nut housing for converting a rotation of the output-shaft journal through the spindle-nut housing and the spindle nut into an axial thrust of the spindle and the restrictor body.

In accordance with a further feature of the invention, there is provided a ring gear having an inner periphery and being coupled to the rapid-travel mechanism, the planetary gear stage being connected to the output-shaft journal, the planetary gear stage including a sun gear having an outer periphery and being moved by the regulating drive, and the planetary gear stage including planet gears meshing with the outer periphery of the sun gear and with the inner periphery of the ring gear.

In accordance with an added feature of the invention, the non-self-locking gear unit coupling the rapid-travel mechanism to the planetary gear stage is a non-self-locking worm drive.

In accordance with an additional feature of the invention, there are provided means for remotely actuating a release of a braking engagement of the brake device when the response pressure occurs, and a free-wheel mechanism coupled to the shaft of the rapid-travel mechanism for permitting rotation of the shaft only in a direction of rotation corresponding to the safety movement of the restrictor body.

In accordance with yet another feature of the invention, the at least one brake device has a first brake disc sitting securely on and rotating with the shaft of the rapid-travel mechanism and a second brake disc being axially displaceably but non-rotatably mounted and normally in braking engagement with the first brake disc, the second brake disc being mounted for movement into and out of braking engagement, and the free-wheel mechanism being a directional locking mechanism permitting the shaft to rotate only in a direction of rotation corresponding to the safety movement of the restrictor body, in a non-securely braked state of the shaft.

In accordance with yet a further feature of the invention, there is provided at least one ratchet wheel having a ratchet tooth system, the at least one ratchet wheel sitting securely on the shaft of the rapid-travel mechanism, the shaft having an axis, and at least one pawl being pivotably mounted about a pawl axis parallel to the shaft axis and being spring-loaded into engagement with the ratchet tooth system.

In accordance with yet an added feature of the invention, there is provided a pressure-monitoring configuration being connected in a pressure-transmitting manner to a working-medium pipeline of the safety valve for monitoring an actual pressure and for tripping the brake device when the response pressure is reached, the pressure-monitoring configuration having pressure monitors for issuing tripping signals, and an electromagnet configuration receiving the tripping signals for normally holding the brake device for the shaft of the rapid-travel mechanism in braking engagement and for lifting the brake device when the tripping-signals are received.

In accordance with yet an additional feature of the invention, the pressure monitors are at least two pressure monitors, the electromagnetic configuration has at least two brake magnets each being connected downstream of a respective one of the pressure monitors, and a common transmission member coupling at least two of the brake magnets to the second brake disc for controlling the second brake disc by lifting the second brake disc when at least one of the brake magnets responds or when at least one tripping signal from the pressure monitors is present.

In accordance with again another feature of the invention, the at least two pressure monitors and the at least two brake magnets are disposed in a three-channel configuration having one pressure monitor/brake magnet pair per channel, the pressure monitor/brake magnet pairs having a one-of-three tripping action of the brake magnets by the pressure monitors and a one-of-three tripping action of the second brake disc by the brake magnets.

In accordance with again a further feature of the invention, the safety valve is an opening valve having a valve opening direction for protection against excess pressure in components or pipelines connected to the inflow side, and the rapid-travel mechanism has a permitted direction of rotation corresponding to the valve opening direction.

In accordance with again an added feature of the invention, the safety valve is a closing valve having a valve closing direction for protection against excess pressure in components or pipelines connected to the outflow side, and the rapid-travel mechanism has a permitted direction of rotation corresponding to the valve closing direction.

In accordance with again an additional feature of the invention, there are provided pressure monitors associated with the inflow side of the safety valve for issuing tripping signals, at least one brake magnet connected downstream of one of the pressure monitors for locking or releasing the rapid-travel mechanism, at least one additional safety leg, a signal line connecting the at least one additional safety leg downstream of another of the pressure monitors, the non-self-locking spindle drive having a valve spindle with a first spindle section connected to the restrictor body and a second spindle section flexibly coupled to the first spindle section, the additional safety leg having means for displacing the first spindle section into an open position relative to the second spindle section, when the pressure-monitor tripping signal is present.

In accordance with still another feature of the invention, there is provided a compression-spring configuration coupling the first spindle section to the second spindle section, a safety lever linked to an end of the first spindle section facing away from the restrictor body, the safety lever having at least one free end, a secondary spindle extending substantially parallel to the valve spindle, a slot joint linking the secondary spindle to the at least one free end of the safety lever, a non-self-locking secondary spindle drive for the secondary spindle, the non-self-locking secondary spindle drive having a spindle nut, at least one first brake disc mounted for rotation with the spindle nut, and another brake magnet normally holding the secondary spindle in place on the brake disc and releasing the spindle nut for rotation and the secondary spindle for axial movement, in the event of a tripping signal being supplied from one of the pressure monitors.

In accordance with still a further feature of the invention, there is provided a housing for the secondary spindle drive and the other brake magnet, the housing being rigidly coupled to and longitudinally displaceably mounted with the second spindle section.

In accordance with a concomitant feature of the invention, the safety lever has a rocker-like two-armed construction, and including another secondary spindle, another secondary spindle drive for the other secondary spindle, the at least one free end of the safety lever being two free ends, the secondary spindles each being linked to a respective one of the free ends of the safety lever, a further brake magnet, another housing for the other secondary spindle and the further brake magnet, a housing bridge interconnecting the housings and the brake magnets, and the housing bridge being firmly connected to the second spindle section.

The advantages achievable with the invention can in particular be seen in the fact that a separate rapid-travel motor of, for example, up to 27 kW power no longer needs to be used for the servo drive. On the contrary, the drive for the valve spindle in the event of safety tripping is actuated by the inherent medium. Separate hydraulic drives or pressure-relieved actuators, which have constant leakage losses, are also dispensed with.

Other features which are considered as characteristic for the invention are set forth in the appended claims.

Although the invention is illustrated and described herein as embodied in a servo drive for safety and regulating valves, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 4 is a simplified diagrammatic and schematic view of a planetary gear stage as used in the servo drives according to FIGS. 1 to 3;

FIG. 5 is a plan view of the configuration of ring gear/planet gear/sun gears according to FIG. 4; and FIG. 6 shows a table for FIGS. 4 and 5 which reveals additional information about the function of the rapid-travel mechanism.

The construction and function of three exemplary embodiments are explained below in the sequence of FIGS. 1 to 3 and then FIGS. 4 to 6.

DESCRIPTION OF THE PREFERRED EMBODIMENTS

Figure 1:
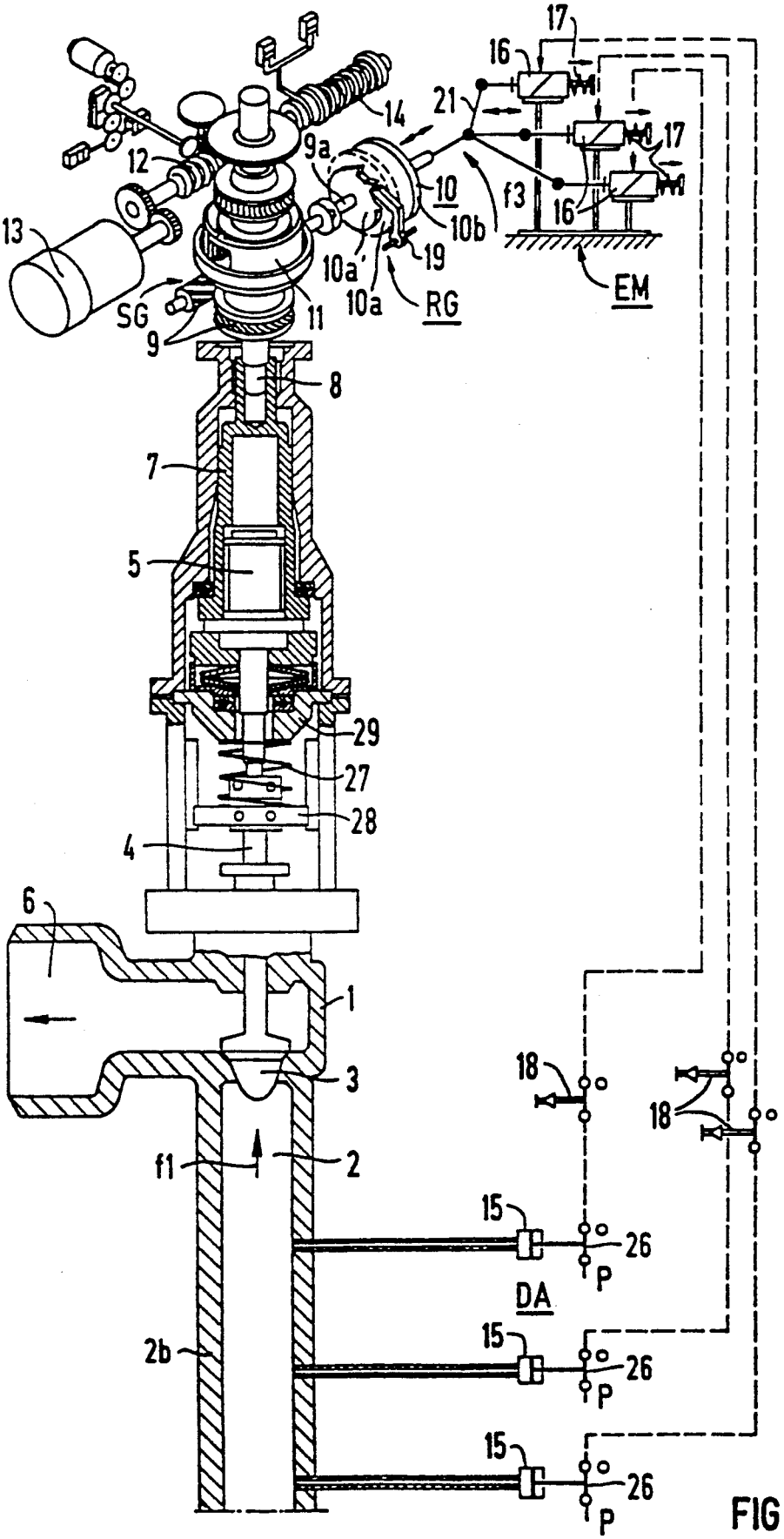
FIG. 1 is a fragmentary, diagrammatic, partly sectional perspective view of a safety valve having a positive direction of action, i.e. the safety valve opens when a response pressure is reached on the inflow side of the valve.

Referring now to the figures of the drawing in detail and first, particularly, to FIG. 1 thereof, there is seen a safety station having a safety function, which is actuated by an inherent medium, in a positive direction of action. Steam flows through an inlet piping connection 2 from a working-medium pipeline **2*b* of a safety valve in a valve opening direction indicated by flow arrows fl, against a restrictor body 3 (in this case, e.g., a parabolic restrictor body) of the steam valve having a housing 1. The steam exerts an axial force on the restrictor body 3, on a spindle 4 and on a spindle nut 5. The axial force is in proportion to the effective cross-section of the restrictor body and the pressure difference between the inlet piping connection 2 and an outlet piping connection 6** and acts in the opening direction.

The axial force produced by the inherent medium (steam) is converted into a torque in the non-self-locking (in contrast to conventional spindle nuts) and rotatably mounted spindle nut 5. The torque is transmitted through a spindle-nut housing 7 that is firmly connected to the spindle nut 5, to an output-shaft journal 8 of a servo drive.

The torque passes from the output-shaft journal 8 through a planetary gear stage 11 on one hand to a worm stage 9 having a shaft **9*a* and being likewise non-self-locking in contrast to conventional planetary gear units and is securely braked by a brake device 10 at pressures below a safety pressure, and on the other hand to a self-locking worm stage 12**, where it is compensated.

A servo drive motor 13, which also acts on this self-locking worm stage 12 and in normal operation is controlled by a control system, effects an adjustment of the restrictor body 3.

The function of the worm stage 12, the action of the servo drive or regulating motor 13 (also designated as drive or servo motor), the torque-dependent control by displacement of the worm and compression of a torque spring 14, correspond to previous proven servo-drive technology (e.g. Siemens servo drives).

If the pressure in the inlet piping connection 2 or in the systems located in upstream of it increases above a value set at pressure monitors 15 of a pressure-monitoring configuration DA, switch contacts 26 open and connected brake magnets 16 of a brake-magnet configuration EM become dead and fall back into a neutral position.

A mechanical coupling of the brake magnets 16 to the brake device 10 in combination with springs 17, is constructed in such a way that even the release of one brake magnet brings about reliable lifting of the brake device 10.

With the lifting of the brake device 10, the non-self-locking worm stage 9 is released.

The axial thrust produced by the inherent medium (steam) and acting through the restrictor body 3 and the valve spindle 4 is converted into a torque in the non-self-locking spindle nut 5 and sets the spindle nut 5, the spindle-nut housing 7, the output-shaft journal 8, the planetary gear stage 11 and the non-self-locking worm stage 9 into rotary motion. As a result, the restrictor body 3 and the valve spindle 4 move upwards in accordance with the thread pitch in the spindle nut 5. As long as at least one of the switch contacts at the pressure monitors 15 remains open, the valve is opened up to the open end position. In the event of premature pressure reduction and the closing of the contacts at the pressure monitors 15 associated therewith, the opening action (safety stroke) actuated by the inherent medium is ended by the braking of the non-self-locking worm stage 9 through the brake device 10.

It is also possible, through the use of a manual key 18, to carry out specific partial-stroke or full-stroke tests below the response pressure of the pressure monitors 15.

The opening action (safety stroke) actuated by the inherent medium can be effected from the closed end position and from any intermediate position.

If the supply voltage at the pressure monitors 15 fails, a release of the opening action (safety stroke) actuated by the inherent medium is likewise effected.

The opening action (safety stroke) actuated by the inherent medium is also effected when the servo drive or regulating motor 13 is simultaneously actuated in the closing direction, if contacts of the pressure monitors 15 are open. Compensation is effected in this case through the planetary gear stage 11.

If the servo drive or regulating motor 13 is simultaneously actuated in the opening direction (safety direction) when the safety stroke is tripped, this regulating movement is additionally superimposed on the opening action actuated by the inherent medium. This is effected by a pawl 19 of a directional locking or free-wheel mechanism RG which engages into a toothed ratchet wheel or locking wheel **10*a*' of the brake device 10 and releases this locking wheel 10*a*' only in the direction of rotation produced by the opening action (safety stroke) actuated by the inherent medium. The ratchet wheel 10*a*' is connected to a first brake disc 10*a* in such a way as to be fixed in terms of rotation. The first brake disc 10*a* sits securely on and rotates with the shaft 9*a* of the non-self-locking gear unit 9, and a second brake disc 10*b* is axially displaceably but non-rotatably mounted and normally in braking engagement with the first brake disc 10***a*. The second brake disc 10*b* is mounted for movement into and out of braking engagement. A common transmission member 21 couples at least two of the brake magnets 16 to the second brake disc 10*b* for controlling the second brake disc 10*b* by lifting the second brake disc 10*b* when at least one of the brake magnets responds or when at least one tripping signal from the pressure monitors 15 is present.

With regard to FIG. 1, it should also be added that in this figure an auxiliary closing spring 27, which is designated as a helical compression spring, is inserted between a cover 28 of the spindle 4 and a retaining body 29 fixed to the housing. The spring 27 has the task of preventing fluttering of the restrictor body 3 at small differential pressures between the inlet piping connection 2 and the outlet piping connection 6.

Figure 2:
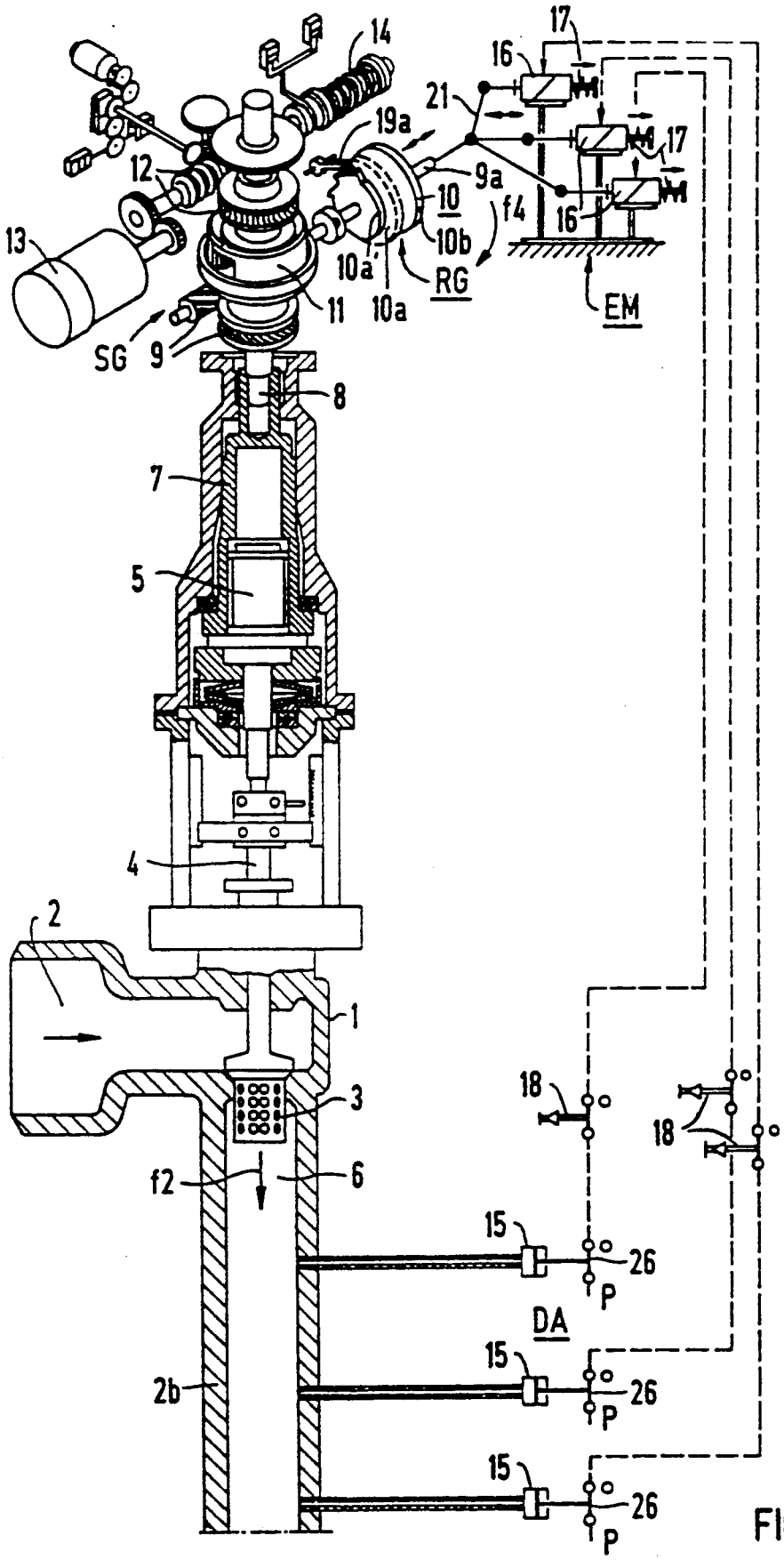
FIG. 2 is a view similar to FIG. 1 showing a servo drive for a safety valve having a negative direction of action, i.e. the safety valve closes when the response pressure is reached on its outflow side.

In FIG. 2, the reference numerals are 2 and 6 are reversed as compared to FIG. 1, so that the same reference numeral identifies an element which functions in the same way. FIG. 2 illustrates the function of the safety station having a safety function, which is actuated by the inherent medium in a negative direction. Steam flows from above through the inlet piping connection 2 and through the restrictor body 3 (in this case, e.g. a perforated restrictor body) to the steam valve having the housing 1.

The steam exerts an axial force on the restrictor body 3, the spindle 4 and the spindle nut 5. The axial force is in proportion to the effective cross-section of the restrictor body and the pressure difference between the inlet piping connection 2 and the outlet piping connection 6 and acts in the closing direction. As is shown by flow arrows f2, the steam forces act in the closing direction of the restrictor body 3. The safety movement of the restrictor body 3 also takes place in this direction so that the free-wheel rotation of the directional locking mechanism RG now takes place in the clockwise direction f4 (in the example according to FIG. 1 the free-wheel rotation takes place in the counter-clockwise direction f3). Otherwise, the servo drive according to FIG. 2 is constructed like that according to FIG. 1, and therefore the same parts are provided with the same reference numerals and the functional sequence is analogous.

If the pressure in the outlet piping connection 6 or in the systems located downstream of it increases above the value set at the pressure monitors 15, switch contacts 26 open and the connected brake magnets 16 become dead and fall back into their neutral position.

The mechanical coupling of the brake magnets 16 to the brake device 10 in combination with the springs 17 is constructed in such a way that even the release of one magnet brings about reliable lifting of the brake device 10.

With the lifting of the brake device 10, the non-self-locking worm stage 9 is released.

The axial thrust which is produced by the inherent medium (steam) and which acts through the restrictor body 3 and the valve spindle 4, is converted into a torque in the non-self-locking spindle nut 5 and sets the spindle nut 5, the spindle-nut housing 7, the output-shaft journal 8, the planetary gear stage 11 and the non-self-locking worm stage 9 into rotary motion. As a result, the restrictor body 3 and the valve spindle 4 move downwards in accordance with the thread pitch in the spindle nut 5. As long as at least one of the switch contacts at the pressure monitors 15 remains open, the valve is closed up to the closed end position.

In the event of premature pressure reduction and the closing of the contacts at the pressure monitors 15 associated therewith, the closing action (safety stroke) actuated by the inherent medium is ended by the braking of the non-self-locking worm stage 9 through the brake device 10.

It is also possible, through the manual key 18, to carry out specific partial-stroke or full-stroke tests below the response pressure of the pressure monitors 15.

The closing action (safety stroke) actuated by the inherent medium can be effected from the open end position and from any intermediate position.

If the supply voltage at the pressure monitors 15 fails, a release of the closing action (safety stroke) actuated by the inherent medium is likewise effected.

The closing action (safety stroke) actuated by the inherent medium is also effected when the servo drive or regulating motor 13 is simultaneously actuated in the open direction, if the contacts of the pressure monitors 15 are open. Compensation is effected in this case through the planetary gear stage 11.

If the servo drive or regulating motor 13 is simultaneously actuated in the closed direction (safety direction) when the safety stroke is tripped, this regulating movement is additionally superimposed on the closing action actuated by the inherent medium. This is effected by a pawl 19*a* which engages into the toothed ratchet wheel or locking wheel 10*a*' of the brake device 10 and releases this locking wheel 10*a*' only in the direction of rotation produced by the closing action (safety stroke) actuated by the inherent medium. In the safety function in the negative direction, this direction of rotation is opposite to that in the safety function in the positive direction.

Figure 3:
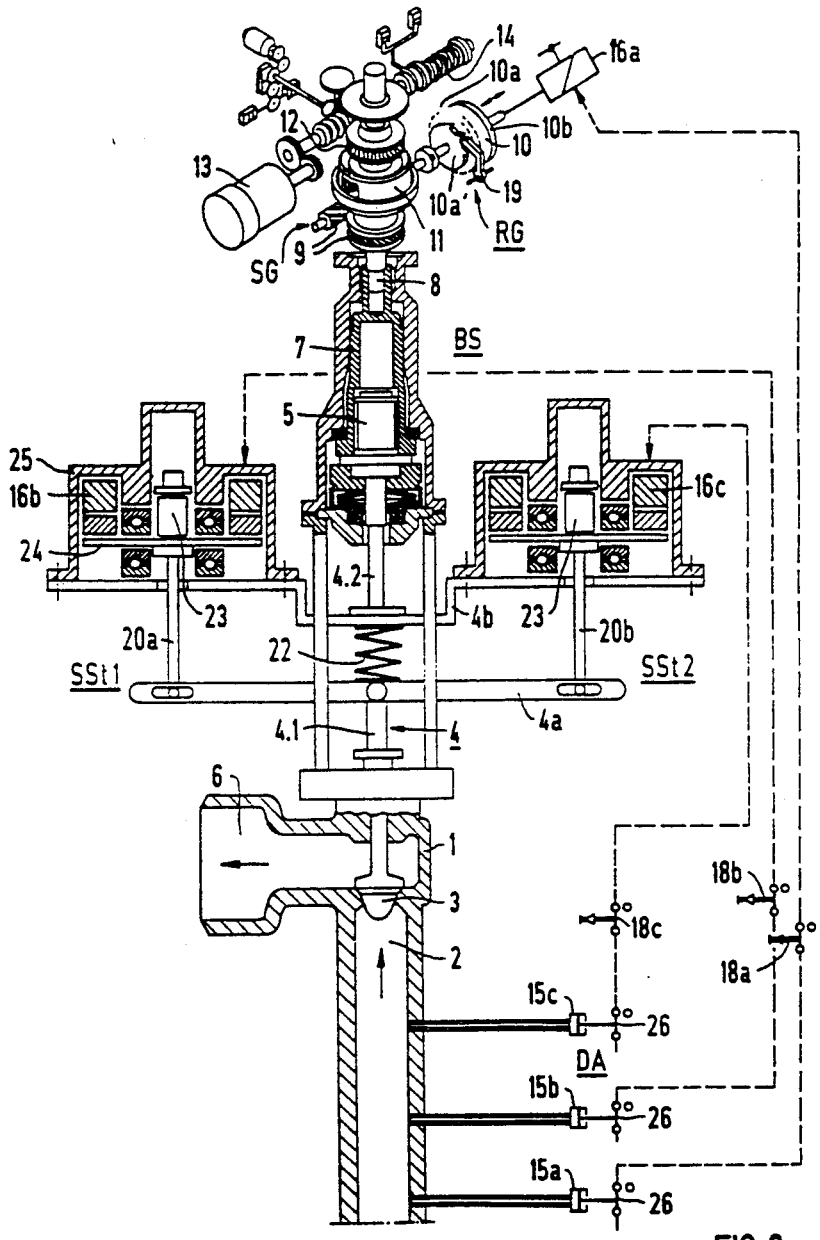
FIG. 3 is another view similar to FIGS. 1 and 2, showing a servo drive for a safety valve which is likewise actuated by an inherent medium and in principle is constructed just like that according to FIG. 1, but in which two additional safety legs are provided.

The exemplary embodiment according to FIG. 3 likewise relates to a safety station which is suitable for reducing and metering energy flows (gases, water) in process engineering and at the same time for reliably protecting the plant systems from excess pressure, and in fact with a safety function that is actuated by an inherent medium in the opening direction.

The safety station is essentially formed of an operating leg and two additional safety legs. Tripping of the safety stroke can be effected both through the operating leg and through each individual safety leg. The operating leg is formed of a motor-driven servo drive, a non-self-locking spindle nut and the regulating member having the restrictor body.

The two additional safety legs, which are independent of one another, are disposed between the spindle nut and the regulating member of the operating leg. They are formed of non-self-locking gear stages which can be securely braked. In the securely braked state, the safety legs form a rigid connection between the spindle nut and the regulating member of the operating leg. The safety stroke is actuated by the inherent medium in accordance with the direction of flow towards the restrictor body in the regulating member.

The motor-driven servo drive is a modification of the proven Siemens double-motor drive with a planetary gear unit. The previous engagement point of a rapid-travel motor, which is a self-locking worm stage, is replaced by a non-self-locking worm stage having an electromagnetic brake device on the worm shaft. During normal operation, this non-self-locking worm stage remains securely braked. When the safety function responds, the brake device lifts and releases the worm stage for the operating-leg safety stroke that is actuated by the inherent medium.

The torque required to perform the safety stroke through the operating leg is applied to the motor-driven servo drive by the inherent medium through the restrictor body, the valve spindle, the spindle linkage, the securely braked safety legs and the non-self-locking spindle nut.

The safety stroke is performed through the safety legs by lifting the associated brake devices at the spindle nuts of the non-self-locking thread stages of the safety legs. The spindle shafts, which are fixed in such a way as to be locked against rotation, are pressed into the nuts by the force of the inherent medium and, when the brake is lifted, they set the nuts in rotary motion and thereby enable the regulating member to be opened reliably. In the process, both safety legs work completely independently of one another. The lifting of the brake device on one safety leg is already sufficient to reliably open the regulating member.

An operating leg BS is essentially formed of a motor-driven servo drive, a non-self-locking spindle nut 5 and the regulating member 1, 3.

Two safety legs SSt 1, SSt 2 are respectively formed of securely brakeable, non-self-locking worm stages 20*a*, 23; 20*b*, 23, which are coupled through a suitable spindle linkage 4*a*, 4*b* and are disposed beteween the spindle nut 5 and the regulating member 1, 3. A spring element 22 is inserted along the longitudinal axis of the spindle 4, between a safety lever 4*a* and a housing bridge 4*b* of the spindle linkage.

Steam flows through the inlet piping connection 2 against the restrictor body 3 (in this case, e.g., a parabolic restrictor body) of the steam valve having the housing 1. The steam exerts an axial force on the restrictor body 3, the spindle 4, the spindle linkage in the form of the safety lever 4*a* and the housing bridge 4*b*, safety spindles 20*a* and 20*b* and the spindle nut 5. The axial force is in proportion to the effective cross section of the restrictor body and the pressure difference between the inlet piping connection 2 and the outlet piping connection 6 and acts in the opening direction.

The axial force produced by the inherent medium (steam) is converted into a torque in the non-self-locking and rotatably mounted spindle nut 5, and further explanations relative to the first exemplary embodiment according to FIG. 1 in the second, third, fourth, fifth and sixth paragraphs of the Description of the Preferred Embodiments, apply to this exemplary embodiment.

With the lifting of the brake device, the non-self-locking worm stage 9 is released.

The axial thrust being produced by the inherent medium (steam) and acting through the restrictor body 3, the valve spindle 4 and the spindle linkage 4*a* and 4*b* having the safety spindles 20*a* and 20*b*, is converted into a torque in the non-self-locking spindle nut 5 and sets the spindle nut 5, the spindle-nut housing 7, the output-shaft journal 8, the non-self-locking worm stage 9 and the planetary stage II into rotary motion. As a result, the restrictor body 3, the valve spindle 4 and the spindle linkage 4*a* and 4*b* having the safety spindles 20*a* and 20*b* move upwards in accordance with the thread pitch in the spindle nut 5. The valve is opened up to the open end position if the switch contact of a pressure monitor 15*a* remains open long enough.

In the event of a premature pressure reduction and the closing of the pressure-monitor contact 15*a* associated therewith, the opening action of the operating leg BS (safety stroke) actuated by the inherent medium is ended by the braking of the non-self-locking worm stage 9 with the brake device 10.

It is also possible, through a manual key 18*a*, to carry out specific partial-stroke or full-stroke tests below the response pressure of the pressure monitor 15*a*.

The opening action (safety stroke) of the operating leg BS being actuated by the inherent medium can be effected from the closed end position and from any intermediate position.

If the supply voltage at the pressure monitor 15*a* fails, a release of the opening action (safety stroke) actuated by the inherent medium is likewise effected through the operating leg BS.

The opening action (safety stroke) of the operating leg BS, which is actuated by the inherent medium, is also effected when the servo drive or regulating motor 13 is simultaneously actuated in the closing direction, if the pressure-monitor contact 15*a* is open. Compensation is effected in this case through the planetary gear stage 11.

If the servo drive or regulating motor 13 is simultaneously actuated in the opening direction (safety direction) when the safety stroke of the operating leg is tripped, this regulating movement is additionally superimposed on the opening action actuated by the inherent medium. This is effected by the pawl 19 of the directional locking mechanism RG which engages into the toothed ratchet wheel or locking wheel 10*a*′ of the brake device 10 and releases this locking wheel 10*a*′ only in the direction of rotation produced by the opening action (safety stroke) actuated by the inherent medium. The same action can also be achieved with a free-wheel (instead of the pawl 19 and the locking wheel 10*a*′).

In addition to the operating leg BS, the two independent safety legs SSt 1, SSt 2 are connected. The safety legs SSt 1, SSt 2 are essentially formed of the non-self-locking safety spindles 20*a* and 20*b* having associated brake magnets 16*b* and 16*c*.

In the normal operating state, the safety spindles 20*a*, 20*b* are in the extended state (in accordance with the position shown). At the same time, the two safety spindles are securely braked by associated safety-spindle nuts 23 and the respective brake magnets 16*b* and 16*c*. Consequently, there is a rigid connection between the parts 4*a* and 4*b* of the spindle linkage and thus also between first and second spindle sections 4.1, 4.2. However, if the brake magnets 16*b* or 16*c* become dead through the response of pressure monitors 15*b* or 15*c*, the rigid connection between the spindle linkage parts 4*a* and 4*b* is neutralized. The force of the inherent medium then acts through the first spindle section 4.1 and pushes the tiltably mounted spindle linkage 4*a* and the safety spindle 20*a* or 20*b* upwards through the rotating safety-spindle nuts.

The restrictor body 3 can always reach the open end position as soon as the safety stroke is tripped through one leg (operating or safety leg). This also applies of course during the simultaneous response of two or three legs.

The safety legs can likewise be tested separately through manual keys 18*b* and 18*c* as well as the brake magnets 16*b* and 16*c*. In this case, testing is likewise possible below the safety pressure.

It will be recognized from FIG. 3 that at least one brake magnet 16*a* is connected downstream of a pressure monitor 15*a*. The brake magnet 16a locks or releases a rapid-travel mechanism SG. The at least one additional safety leg SSt 1, which is connected downstream of the further pressure monitor 15*b* over a signal line, has means provided by the elements 16*b*, 20*a*, 4*a* for displacing the first spindle section 4.1 with the restrictor body 3, when a pressure-monitor tripping signal is present. The first spindle section 4.1 and the restrictor body 3 are displaced into the open position relative to the second spindle section 4.2, which is coupled in a flexible manner (by the spring 22) to the first spindle section 4.1 and has the non-self-locking spindle drive. As mentioned above, two additional safety legs SSt 1, SSt 2 are shown and the first spindle section 4.1 is coupled to the second spindle section 4.2 through the spring element or compression-spring configuration 22. Linked to the end of the first spindle section 4.1 facing away from the restrictor body 3 is the safety lever 4*a* that has at least one free end to which the safety or secondary spindle 20*a*, 20*b* running essentially parallel to the valve spindle 4 is linked through a slot joint. The safety or secondary spindle 20*a*, 20*b* has a non-self-locking secondary spindle drive with at least one first brake disc 24 that is mounted in such a way as to rotate with the spindle nut 23, and the second brake magnet 16*b* which normally holds the safety or secondary spindle 20*a* in place on its brake disc 24. In the event of a tripping signal being supplied from the associated pressure monitor 15*b*, the brake magnet 16*b* releases the spindle nut 23 for rotation and the safety or secondary spindle 20*a* for axial movement. A housing 25 of the secondary spindle drive and the second brake magnet 16*b* is rigidly coupled to the second spindle section 4.2 and is mounted together with the latter in a longitudinally displaceable manner. The second safety leg SSt 2 corresponds to the first safety leg SSt 1. The safety lever 4*a* is therefore preferably of two-armed construction like a rocker, and one respective secondary spindle 20*a*, 20*b* having one respective secondary spindle drive is linked to each of its two free ends. The housings 25 of the two secondary spindle drives and their associated brake magnets 16*b*, 16*c* are connected to one another through a housing bridge 4*b*, and the housing bridge 4*b* is firmly connected to the second spindle section 4.2 of the valve spindle 4.

Explanation of FIGS. 4 to 6

A planetary gear stage is generally designated by reference symbol B in FIGS. 4 to 6. The planetary gear stage has two planet gears $b_1$ and $b_2$ which are located diametrically opposite one another and which mesh with a sun gear A at their inner peripheries and with an internal tooth system of a ring gear C at their outer peripheries. The ring gear C belongs to the rapid-travel mechanism SG, i.e., if the latter is released by the brake magnets, the output-shaft journal can rotate in an unbraked manner through the worm drive 9 shown in FIGS. 1 to 3 and the restrictor body 3 moves into its open position (FIG. 1 or 3) or into its closed position (FIG. 2).

The table according to FIG. 6 first of all shows that, during the regulating operation, the sun gear A is driven and drives the planetary gear stage B with it, whereas the rapid-travel mechanism SG is securely braked. In effect, the inner gear rim of the ring gear C represents a fixed roller track for the planet gears $b_1$, $b_2$.

If a signal "response pressure reached" is now produced by one of the pressure monitors because the pressure P is greater than the response pressure PGr, the corresponding brake magnet is lifted, i.e. the rapid-travel mechanism SG is released, which is the condition dealt with in the right-hand column of the table according to FIG. 6. The planetary gear stage driven by the output-shaft journal through the worm drive, drives the shaft of the rapid-travel mechanism SG with it, wherein it is immaterial whether or not the sun gear A is moved by the regulating mechanism. In this operating case (response of the safety mechanism), the sun gear A represents a roller track for the planet gears $b_1$, $b_2$ and is either stationary (if no regulating command is present) or moves by itself.

The compression-spring configuration 22 in the example according to FIG. 3 in particular has the following tasks:

a) Damping the movement of the restrictor body 3, in particular at high steam pressures, so that the restrictor body 3 cannot "strike" the housing 1. This is of importance at the relatively high steam forces of 10 t to 20 t;

b) Displacing the spindle section 4.2 of the operating leg BS into the open end position if one or both safety legs SSt 1, SSt 2 should respond before the operating leg BS, and c) Returning the safety legs SSt 1, SSt 2 into their original position shown.

I claim:

1. In a safety station having a safety and regulating valve for metering energy flows in the form of gases, steam or water, the valve having an inflow side, an outflow side, a valve seat, and at least one restrictor body defining a restrictor cross-section through which a working medium flows, said at least one restrictor body being adjustable relative to the valve seat for opening or closing the restrictor cross-section when a response pressure at least reaches a limit of a permissible pressure on one of the inflow and outflow sides, a servo drive for the valve, comprising:

a non-self-locking spindle drive for the restrictor body, a regulating drive having a regulating motor, a rapid-travel mechanism, a planetary gear stage coupled to said spindle drive for superimposing an introduction of a first drive torque from said regulating drive and a second drive torque through said rapid-travel mechanism for rapidly opening or closing the valve when the response pressure is at least reached, means for deriving a drive force for a safety movement of the restrictor body from a working-medium pressure difference acting on the restrictor body, a non-self-locking gear unit coupling said rapid-travel mechanism to said planetary gear stage, said non-self-locking gear unit having at least one shaft, a releasable brake device normally securely braking said at least one shaft, and said brake device releasing said rapid-travel mechanism for driving the safety movement of the restrictor body into a desired position with the inherent medium, when the response pressure occurs.

2. The servo drive according to claim 1, wherein said spindle drive for the restrictor body has a valve spindle, a spindle nut rotatably mounted on said valve spindle, a spindle-nut housing rotatably mounting but axially fixing said spindle nut, and an output-shaft journal on said spindle-nut housing for converting a rotation of said output-shaft journal through said spindle-nut housing and said spindle nut into an axial thrust of said spindle and the restrictor body.

3. The servo drive according to claim 2, including a ring gear having an inner periphery and being coupled to said rapid-travel mechanism, said planetary gear stage being connected to said output-shaft journal, said planetary gear stage including a sun gear having an outer periphery and being moved by said regulating drive, and said planetary gear stage including planet gears meshing with the outer periphery of said sun gear and with the inner periphery of said ring gear.

4. The servo drive according to claim 1, wherein said non-self-locking gear unit coupling said rapid-travel mechanism to said planetary gear stage is a non-self-locking worm drive.

5. The servo drive according to claim 1, including means for remotely actuating a release of a braking engagement of said brake device when the response pressure occurs, and a free-wheel mechanism coupled to said shaft of said non-self-locking gear unit for permitting rotation of said shaft only in a direction of rotation corresponding to the safety movement of the restrictor body.

6. The servo drive according to claim 5, wherein said brake device has a first brake disc sitting securely on and rotating with said shaft of said non-self-locking gear unit and a second brake disc being axially displaceably but non-rotatably mounted and normally in braking engagement with said first brake disc, said second brake disc being mounted for movement into and out of braking engagement, and said free-wheel mechanism being a directional locking mechanism permitting said shaft to rotate only in a direction of rotation corresponding to the safety movement of the restrictor body, in a non-securely braked state of the shaft.

7. The servo drive according to claim 6, including a pressure-monitoring configuration being connected in a pressure-transmitting manner to a working-medium pipeline of the safety valve for monitoring an actual pressure and for tripping said brake device when the response pressure is reached, said pressure-monitoring configuration having pressure monitors for issuing tripping signals, and an electromagnet configuration receiving the tripping signals for normally holding said brake device for said shaft of said non-self-locking gear unit in braking engagement and for lifting said brake device when the tripping-signals are received.

8. The servo drive according to claim 7, wherein said pressure monitors are at least two pressure monitors, said electromagnetic configuration has at least two brake magnets each being connected downstream of a respective one of said pressure monitors, and a common transmission member coupling at least two of said brake magnets to said second brake disc for controlling said second brake disc by lifting said second brake disc when at least one of said brake magnets responds or when at least one tripping signal from said pressure monitors is present.

9. The servo drive according to claim 8, wherein said at least two pressure monitors are three pressure monitors and said at least two brake magnets are three brake magnets, said pressure monitors and said brake magnets being disposed in a three-channel configuration having one pressure monitor/brake magnet pair per channel, said pressure monitor/brake magnet pairs having a one-of-three tripping action of said brake magnets by said pressure monitors and a one-of-three tripping action of said second brake disc by said brake magnets.

10. The servo drive according to claim 5, including at least one ratchet wheel having a ratchet tooth system, said at least one ratchet wheel sitting securely on said shaft of said non-self-locking gear unit, said shaft having an axis, and at least one pawl being pivotably mounted about a pawl axis parallel to the shaft axis and being spring-loaded into engagement with said ratchet tooth system.

11. The servo drive according to claim 1, wherein the safety valve is an opening valve having a valve opening direction for protection against excess pressure in components or pipelines connected to the inflow side and said rapid-travel mechanism has a permitted direction of rotation corresponding to the valve opening direction.

12. The servo drive according to claim 11, including pressure monitors associated with the inflow side of the safety valve for issuing tripping signals, at least one brake magnet connected downstream of one of said pressure monitors for locking or releasing the rapid-travel mechanism, at least one additional safety leg, a signal line connecting said at least one additional safety leg downstream of another of said pressure monitors, said non-self-locking spindle drive having a valve spindle with a first spindle section connected to the restrictor body and a second spindle section flexibly coupled to said first spindle section, said additional safety leg having means for displacing said first spindle section into an open position relative to said second spindle section, when the pressure-monitor tripping signal is present.

13. The servo drive according to claim 12, including a compression-spring configuration coupling said first spindle section to said second spindle section, a safety lever linked to an end of said first spindle section facing away from the restrictor body, said safety lever having at least one free end, a secondary spindle extending substantially parallel to said valve spindle, a slot joint linking said secondary spindle to said at least one free end of said safety lever, a non-self-locking secondary spindle drive for said secondary spindle, said non-self-locking secondary spindle drive having a spindle nut, at least one first brake disc mounted for rotation with said spindle nut, and another brake magnet normally holding said secondary spindle in place on said brake disc and releasing said spindle nut for rotation and said secondary spindle for axial movement, in the event of a tripping signal being supplied from one of said pressure monitors.

14. The servo drive according to claim 13, including a housing for said secondary spindle drive and said other brake magnet, said housing being rigidly coupled to and longitudinally displaceably mounted with said second spindle section.

15. The servo drive according to claim 14, wherein said safety lever has a rocker-like two-armed construction, and including another secondary spindle, another secondary spindle drive for said other secondary spindle, said at least one free end of said safety lever being two free ends, said secondary spindles each being linked to a respective one of said free ends of said safety lever, a further brake magnet, another housing for said other secondary spindle and said further brake magnet, a housing bridge interconnecting said housings and said brake magnets, and said housing bridge being firmly connected to said second spindle section.

16. The servo drive according to claim 1, wherein the safety valve is a closing valve having a valve closing direction for protection against excess pressure in components or pipelines connected to the outflow side, and said rapid-travel mechanism has a permitted direction of rotation corresponding to the valve closing direction.

17. In a safety station having a safety and regulating valve for metering energy flows, the valve having an inflow side, and outflow side, a valve seat, and at least one restrictor body defining a restrictor cross-section through which a working medium flwos, said at least one restrictor body being adjustable relative to the valve seat for opening or closing the restrictor cross-section when a response pressure at least reaches a limit of a permissible pressure on one of the inflow and outflow sides, a servo drive for the valve, comprising:

a spindle drive for the restrictor body, a regulating drive, a rapid-travel mechanism for rapidly opening or closing the valve when the response pressure is at least reached, a planetary gear stage coupled to said spindle drive for superimposing a first drive torque from said regulating drive and a second drive torque through said rapid-travel mechanism, a gear unti coupling said rapid-travel mechanism to said planetary gear stage and having a shaft, a releasable brake device normally securely braking said at least one shaft, and said brake device releasing said rapid-travel mechanism for driving the safety movement of the restrictor body into a desired position with the inherent medium, when the response pressure occurs.

* * * * *